United States Patent [19]

Brill

[11] 4,370,108

[45] Jan. 25, 1983

[54] DIAPHRAGM PUMP

[76] Inventor: Joseph H. Brill, 5210 E. Deckerville Rd., Deckerville, Mich. 48427

[21] Appl. No.: 133,240

[22] Filed: Mar. 24, 1980

[51] Int. Cl.[3] ..... F04B 21/02; F04B 39/10; F04B 15/02

[52] U.S. Cl. ..... 417/430; 417/559; 417/900

[58] Field of Search ..... 417/559, 900, 534, 535, 417/536, 538, 537, 430

[56] References Cited

U.S. PATENT DOCUMENTS 2,002,672 5/1981 Melott ..... 417/559

4,252,510 2/1981 Bromley ..... 417/534

*Primary Examiner*—Carlton R. Croyle

*Assistant Examiner*—Peter M. Cuomo

*Attorney, Agent, or Firm*—Krass, Young & Schivley

[57] ABSTRACT

A diaphragm pump is disclosed of a configuration particularly adapted to pumping of liquids containing a high percentage of solids without clogging of the valving and/or pumping chamber. A flexible diaphragm overlies an opening in the pump housing which defines a pumping chamber below the diaphragm which is in communication with inlet and outlet valving chambers, in each of which is disposed respective gravity biased closed inlet and outlet valve overlying valving ports. The valves are guided by valve stems loosely fit into guide tubes extending above each of the valves. Both inlet and outlet flow is directed upwardly through the valve ports in order to insure a cleaning action to avoid clogging of the valves. The inlet flow is directed tangentially into the pumping chamber to create a scouring or turbulent flow action to minimize the tendency for sedimentation and consequent clogging of the pumping chamber.

2 Claims, 4 Drawing Figures

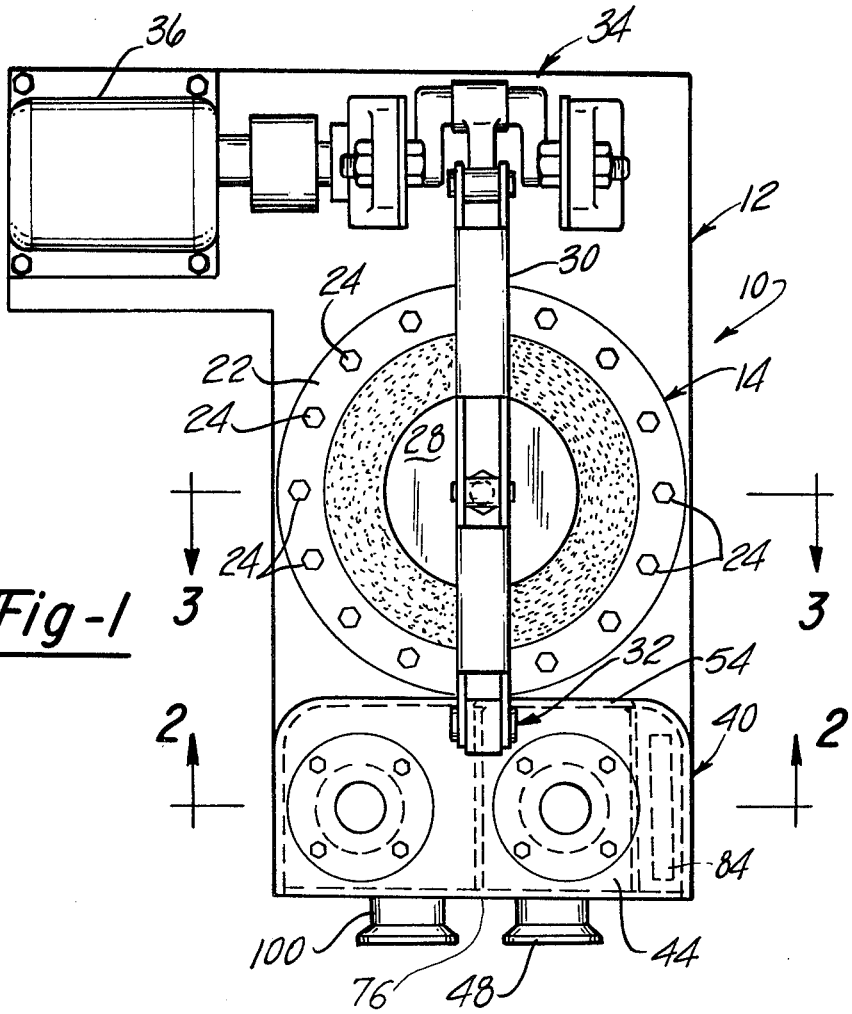
Fig-1
Fig-2
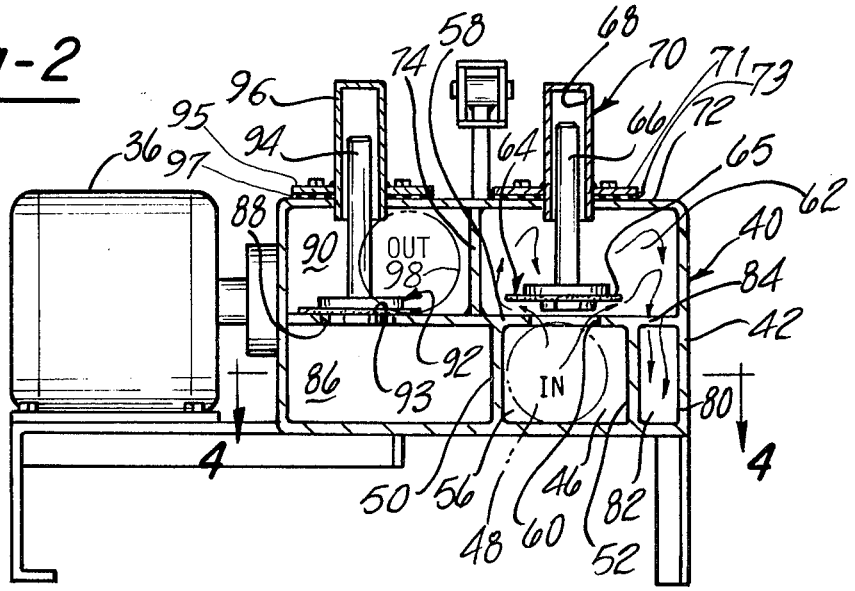

DIAPHRAGM PUMP

BACKGROUND DISCUSSION

This invention concerns pumps and more particularly diaphragm pumps utilized to circulate liquids containing a relatively large percentage of solid materials.

In many applications, it is necessary to cause pumping circulation of liquids containing solid materials, which solid materials may include relatively large particles. Such applications include the pumping of slurry in industrial processing plants, contaminated water in sewage treatment facilities, and water-manure mixture in manure flushing systems.

The relatively large quantity of solid material has a great tendency to clog conventional pumps either due to accumulation of solids in the valving openings and ports, or in the clearance spaces between the moving valve parts, and other pump components.

Another problem is encountered in sedimentation or settling out of the solids in the pumping chamber which may lead to ultimate clogging of the pumping action, requiring clean out, increasing the maintenance requirements of the particular installation and the downtime of the system.

Pump configurations which involve close running clearances between the moving parts, restrictions in the flow path through the pump valving chamber and which produce stagnation in the pumping chamber, renders such design susceptible to clogging and malfunction when applied or utilized for such applications.

Accordingly, it is an object of the present invention to provide a pump which is particularly adapted to the pumping of liquids containing a large quantity of solid materials without clogging or other malfunction due to the presence of solids in the pumped liquid.

It is a further object of the present invention to provide such a pump which operates in a highly reliable manner when pumping such liquids.

It is still another object of the present invention to provide such a pump without such flow restrictions or tight running clearances of components and in which stagnation in the flow pattern at locations which would cause malfunction are substantially eliminated.

It is yet another object of the present invention to provide a pump which is simple in configuration and which may be manufactured at relatively low cost and operate in a highly reliable manner in the environment.

SUMMARY OF THE INVENTION

These and other objects of the present invention, which will become apparent upon a reading of the following specification and claims, are achieved by the provision of a diaphragm pump including a pump housing having a large circular opening formed into an upper horizontal surface of the pump housing, which is overlain by a flexible diaphragm secured to the housing.

A pressure plate secured to the central region of the diaphragm is reciprocated by a crank and lever arm drive arrangement to provide a pulsating pressure in a pumping chamber defined by interior space within the pump housing beneath the diaphragm.

Inlet and outlet valving chambers are also provided in the pump housing in communication with the pumping chamber. The inlet valving chamber comprises a compartment located above an inlet flow compartment located beneath the inlet valving chamber with an inlet valving port comprising a circular opening formed in the partition separating the two chambers.

An inlet valve is disposed including a circular valving disc overlying the inlet valving port in the upper surface thereof such as to be gravity biased into sealing engagement with the valving port. A valve guide stem extends upwardly from the valve disc and is loosely interfit into a guide tube extending above the inlet valving chamber.

The inlet valving chamber is placed into communication with the pumping chamber by a passage extending downwardly out of the inlet valving chamber and thence outwardly into the pumping chamber through an opening defined between a pumping housing sidewall and the partition defining in part the inlet flow compartment. This introduces inlet flow into the pumping chamber in a tangential direction with respect to the pumping chamber which is of generally circular configuration such as to create turbulent tangential flow producing a scouring action in the pumping chamber and minimizing the tendency for sedimentation and clogging to occur in the pumping chamber.

The outlet valving chamber is located alongside the inlet valving chamber in a position elevated above the pumping chamber. The outlet valving chamber is defined by a compartment including a floor partition extending over a space opened to the pumping chamber. An outlet valve port of generally circular configuration is formed in the partition and is overlain by an outlet valving disc on the upper surface thereof producing a gravity biasing of the outlet valving disc into sealing engagement with the outlet valve port.

The valving disc is similarly provided with a guide stem extending upwardly from the guide disc and loosely interfit with a guide tube extending upwardly from the valving outlet chamber. An outlet passage is in communication with the outlet valving.

Thus, upon reciprocation of the diaphragm pressure plate, a pulsating pressure is produced in the pumping chamber. During the low pressure phase of such pulsation, the inlet valving disc is drawn off the seat of the inlet valve port and inlet flow is drawn toward the pumping chamber. Such inlet flow ultimately enters the pumping chamber in a swirling, turbulent manner as mentioned above.

Upon a descending motion of the pressure plate and the production of relatively high pressure in the pumping chamber, the inlet valving disc descends into sealing engagement with the inlet port and the outlet valving disc is unseated from the outlet valving port against the gravity bias, to produce an outflow from the pumping chamber.

In both instances of inlet and outlet flow, flow into the respective valving chambers is upward through the inlet and outlet ports to produce a scouring action at the valve seat and maintaining these surfaces relatively free from the accumulation and solid materials such as to insure proper functioning of the pump and valving.

The loose interfitting of the guide of the valve insures that the clearances have minimal tendency to clog and be positioned over the valve ports, also contributing to a reduced tendency for clogging. The simple gravity bias configuration of the valves insures a high degree of reliability for such applications and are relatively simple in configuration and able to be manufactured at low cost.

DESCRIPTION OF THE DRAWINGS

FIG. 1 is a plan view of a diaphragm pump according to the present invention;

FIG. 2 is a view of the section 2—2 taken through the diaphragm pump shown in FIG. 1;

DETAILED DESCRIPTION

Figure 3:
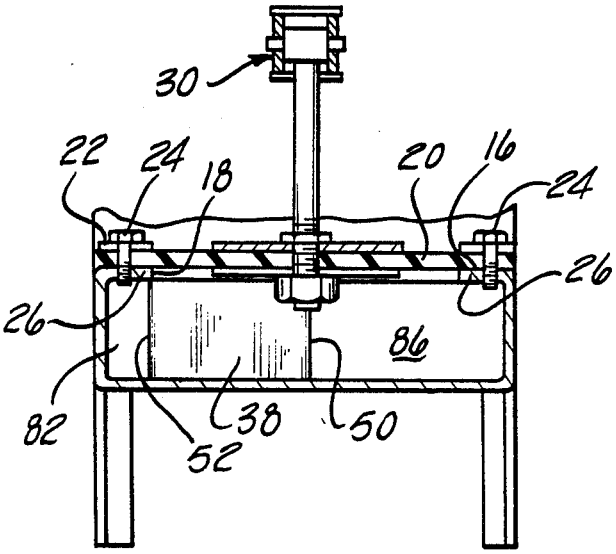
FIG. 3 is a sectional view taken through the section 3—3 of FIG. 1.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings and particularly FIG. 1, the pump 10 according to the present invention includes a pump housing 12. The pump housing 12 includes a chamber section generally indicated at 14 having a generally horizontal top surface 16 formed by an upper top wall into which is formed a large diameter circular opening 18. The circular opening 18 is overlain by a flexible diaphragm 20 of suitable material such as neoprene, mounted by means of a mounting ring 22 in turn secured to the housing by means of a series of bolts 24 threadably received into the pump top wall 26.

Secured to the central region of the diaphragm 20 is a pressure plate 28, the pressure plate 28 in turn mounted to a pumping arm 30. The pumping arm 30 is pivotally mounted to a clevis 32 at one end and at the other end is mounted to a connecting rod and crank arrangement generally indicated at 34. The crank is adapted to be rotated by means of drive means 36 such as an electric motor. Rotation of the crank 34 causes oscillation of the pump lever arm 30, in turn causing reciprocation of the pressure plate 28 so as to cause a flexing of the diaphragm 20. Such flexing of the diaphragm 20 produces pulsation of pressure in a pumping chamber 38 defined by the space within the pumping chamber section 14 of the pumping housing 12 lying beneath the diaphragm 20.

Inflow and outflow from the pumping chamber 38 is established by a valving means including inlet and outlet valving housed within a valving section 40 of the pump housing 12.

The pumping chamber section 14 is configured as best seen in FIG. 1 with a generally concentric outer wall remote from the valving section 40.

Valving section 40 of the pump housing 12 includes a lower section 42 at substantially the same elevation as the pumping chamber 38 and an upper section 44 disposed above the level of the pumping chamber 38.

The lower section 42 is formed with an inlet compartment 46 in communication with the inlet tube 48 adapted to receive a suitable plumbing connection (not shown) to the source of liquid to be circulated. The inlet compartment 46 is created by partition walls 50 and 52 adjacent a section 54 of an outer wall of the pump housing 12 and an inner partition 56 separating the compartment from the pumping chamber 38 and finally an upper partition 58 dividing the lower section 42 from the upper section 44.

The upper partition 58 is formed with an inlet valve port 60 controlling communication of the inlet compartment 46 with an inlet valve chamber 62 located above the inlet chamber 46. Disposed overlying the inlet valve port 60 is a valve disc 64 having a sealing element 65 so as to be gravity biased into sealing engagement with the inlet valve port 60. A valve stem 66 is provided in order to maintain the position of the valve disc 64 over the valve port 60 to guide seating and unseating movements as will be described hereinafter. The valve stem, for this reason, is loosely fit within a guide bore 68 formed in a guide tube 70 secured by a flange 71 screwed to the upper surface 72 of the upper valve housing section 44. Gasket 73 seals the flange 71.

The inlet valve chamber 62 is defined by a compartment including a partition 74 with end walls of the upper valving section 44 of the pump housing 12 and end walls 76.

The partition 52 is offset from the sidewalls 80 of the valving section 40 such as to form the flow passage indicated at 82. Flow passage 82 opens into the pumping chamber 38. Inlet valve chamber 62 in turn is placed into communication with the flow passage 82 by means of a slot 84 formed in the partition 58 in registry with the flow passage 82 such as to enable inlet flow to pass into the inlet valve chamber 62, through the slot 84 into the flow passage 82, and thence into the pumping chamber 38.

Figure 4:
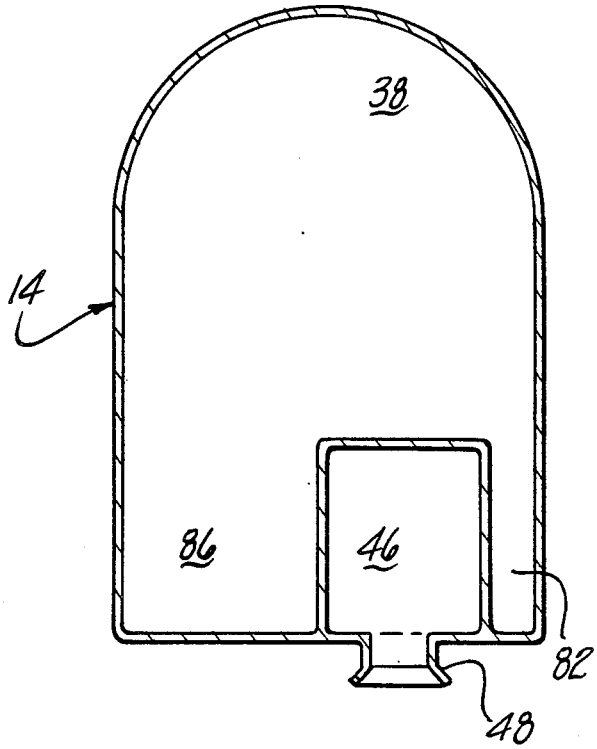
FIG. 4 is a fragmentary partially sectional view of the pump shown in FIG. 1 depicting in flow into the pumping chamber from the inlet valving chamber.

The flow passage 82 is generally arranged such as to be aligned tangentially with the pumping chamber 38 such that inlet flow enters in a swirling turbulent fashion as shown in FIG. 4, producing a scouring action of the inlet flow with respect to the pumping chamber 38 and minimizing the occurrence of sedimentation within the pumping chamber 38.

Pumping chamber 38 also opens into an outlet compartment 86 generally defined by the partitions 58 and the outer and sidewalls of the valving housing section 40 at the lower section 42 thereof. Partition 58 is also formed with an outlet valve port 88 generally of circular configuration directly above the outlet compartment 86.

The outlet valve port 88 is in communication with a valving outlet chamber 90 located above the outlet compartment 86. The partition 74, top surface 72, side and outer walls of the upper valving section 44 defined the outlet valving chamber 90. Disposed overlying the outlet port 88 is an outlet valve disc 92 having sealing element 93 which is thereby gravity biased into sealing engagement therewith and which is provided with a valve stem 94 slidably received within a guide tube 96 such as to control and position the movements of the outlet valve disc 92 and maintain its position overlying the outlet valve port 88. Guide tube 96 is mounted by a flange 95 to the upper surface 72, gasket 97 being provided.

The outlet chamber 90 in turn is provided with an outlet opening 98 aligned with a fitting 100 to be connected to plumbing connections to direct outflow to the system in which the pump is to be installed.

Accordingly, it can be seen that the positioning of the valve discs 92 and 64 and the inlet valve chamber 62 and outlet chamber 90 is above the level of the pumping chamber 38 such that both inflow and outflow are in vertically upward directions through the valving. This insures a scouring effect with respect to the valve seat chambers such as to minimize any tendency for clogging of the various surfaces and clearance spaces.

The downward inverted position of the guide tubes 96 and 70, together with the loose interfitting of the valve stems 66 and 94, is such as to substantially eliminate the tendency for accumulation of solid materials which in turn could lead to malfunctioning of the valving. At the same time, the configuration is extremely simple and reliable in operation such as to be suitable to such applications involving the pumping of liquids containing relatively solid particles of large size. The pump has been determined to be capable of handling liquids with a solid content of up to 25% volume of the combined liquid/solid mixture.

In operation, with the diaphragm 20 moving upwardly, a pressure reduction occurs in chamber 38 which reduces the pressure in the inlet valve chamber 62 causing the valve disc 64 to be lifted from the valve port 60 and allow inflow through the inlet fitting 48 via the inlet compartment 46. The inlet flow is introduced into the flow passage and directed into the pump chamber 38 in a direction directed away from the outlet compartment 86 and tangentially with respect to the generally circular outer wall of the pumping chamber 38 to also minimize the sedimentation within the pumping chamber 38.

Upon movement of the diaphragm 20 downwardly by rotation of the crank mechanism 34, the pressure increases in the pumping chamber 38, causing the inlet valve to be seated in the valve port 60 and at the same time causing the outlet valve disc 92 to be lifted from the outlet port 88 and allowing flow entering the outlet compartment 86 to pass into the outlet valving chamber 90 and thence into the outlet opening 90.

The various parameters of the above design will of course vary with the particular application. An important parameter is the size of the pressure plate 28, since the smaller the pressure plate, the lower the pressure produced in chamber 38, but the greater the displacement thereof.

I claim:

1. A pump comprising:

a pump housing including a pumping chamber section, having a top wall formed with an upper surface thereof defining in part a pumping chamber within said pumping chamber housing;

a generally circular opening formed into said upper wall;

a flexible diaphragm overlying said generally circular opening;

means mounting said diaphragm to said upper surface whereby said pumping chamber is defined in part by said flexible diaphragm;

means for causing reciprocating flexing movement of said diaphragm toward and away from said pumping chamber;

said pump further including a valve housing section adjoining said pumping chamber, said valve section including an inlet compartment located at the level of said pumping chamber including an inlet fitting for connection to the supply of liquid to be pumped thereby;

an inlet valving chamber having upper and lower walls extending parallel to said top wall of the pump housing located above said inlet compartment;

an inlet valve port passing between said inlet compartment and said inlet valving chamber;

valving means controlling communication of said inlet compartment and said inlet valve chamber including a valving disc overlying said inlet valve port;

fluid passage means establishing communication of said inlet valving chamber with said pumping chamber, whereby inlet flow passes into said passage and thence into said pumping chamber;

an outlet compartment having upper and lower walls extending parallel to said top wall of the pump housing located alongside said inlet chamber in open communication with said pumping chamber;

an outlet valving chamber having upper and lower walls extending parallel to said top wall of the pump housing located above said outlet compartment and an outlet valve port establishing communication between said outlet compartment and said outlet valving chamber;

outlet valving means controlling communication through said outlet port, said outlet valving means including an outlet valving disc overlying said outlet valve port;

outlet means for said outlet valving chamber;

whereby inlet flow is drawn into said pumping chamber during upward movement of said diaphragm and lifting of said inlet valve disc to enable inflow into said pumping chamber and upon downward stroking of said flexible diaphragm outflow from said pumping chamber into said outlet valve chamber takes place due to lifting of said outlet valve from said outlet valve port.

2. The pump according to claim 1 wherein each of said inlet and outlet valve discs are formed provided with upwardly extending valve stems and further including a valve guide means including a valve guide tube loosely interfit with said respective valve stem, whereby guiding movement of said valve stem and valve disc maintains said disc in position over said respective valving ports.

* * * * *